US007585423B2

(12) United States Patent
Nakanishi

(10) Patent No.: US 7,585,423 B2
(45) Date of Patent: Sep. 8, 2009

(54) LIQUID DISCHARGE HEAD AND PRODUCING METHOD THEREFOR

(75) Inventor: Koichiro Nakanishi, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 371 days.

(21) Appl. No.: 11/436,646

(22) Filed: May 19, 2006

(65) Prior Publication Data

US 2006/0261035 A1 Nov. 23, 2006

(30) Foreign Application Priority Data

May 23, 2005 (JP) ..... 2005-148895

(51) Int. Cl.
*B41J 2/16* (2006.01)

(52) U.S. Cl. ..... 216/27; 216/47; 216/49; 216/51; 216/56; 216/67; 216/68; 216/79; 29/890.1

(58) Field of Classification Search ..... 269/289 R, 269/302.1; 216/27
See application file for complete search history.

(56) References Cited

U.S. PATENT DOCUMENTS

| | | | | | |
|---|---|---|---|---|---|
| 2,609,024 | A * | 9/1952 | Russ | 269/15 |
| 3,598,164 | A * | 8/1971 | August | 269/13 |
| 4,863,560 | A * | 9/1989 | Hawkins | 216/27 |
| 5,204,690 | A * | 4/1993 | Lorenze et al. | 347/93 |
| 5,363,755 | A * | 11/1994 | Liang | 99/484 |
| 5,996,983 | A * | 12/1999 | Laurenzi | 269/15 |
| 6,371,470 | B1 * | 4/2002 | Ward | 269/289 R |
| 6,375,858 | B1 * | 4/2002 | Makigaki et al. | 216/27 |
| 6,594,898 | B1 * | 7/2003 | Yun | 29/890.1 |
| 6,932,336 | B1 * | 8/2005 | Nudo | 269/302.1 |
| 6,994,336 | B2 * | 2/2006 | Loo | 269/302.1 |
| 7,040,611 | B2 * | 5/2006 | Poynton | 269/289 R |
| 7,213,908 | B2 * | 5/2007 | Chwalek et al. | 347/65 |
| 7,306,744 | B2 * | 12/2007 | Matsuo et al. | 216/27 |
| 2001/0024217 | A1 * | 9/2001 | Kanda et al. | 347/40 |
| 2003/0218290 | A1 * | 11/2003 | Goldberg et al. | 269/289 R |
| 2004/0119221 | A1 * | 6/2004 | Davis | 269/289 R |
| 2004/0246291 | A1 * | 12/2004 | Kinpara | 347/20 |
| 2005/0128255 | A1 | 6/2005 | Nakanishi | |
| 2006/0014107 | A1 * | 1/2006 | Park et al. | 430/320 |
| 2006/0261034 | A1 | 11/2006 | Kurashima et al. | |
| 2007/0001359 | A1 * | 1/2007 | Pearl et al. | 269/289 R |
| 2008/0084451 | A1 * | 4/2008 | Arawaka et al. | 216/27 |
| 2009/0020504 | A1 * | 1/2009 | Yoo et al. | 216/27 |

FOREIGN PATENT DOCUMENTS

| | | |
|---|---|---|
| JP | 5-229128 | 9/1993 |
| JP | 7-156399 | 6/1995 |

* cited by examiner

*Primary Examiner*—Anita K Alanko
(74) *Attorney, Agent, or Firm*—Fitzpatrick, Cella, Harper & Scinto

(57) ABSTRACT

A liquid discharge head includes, on a same substrate, pressure generating chambers, nozzle apertures communicating with the pressure generating chambers through nozzle communicating pans, and a reservoir, wherein a cross-section area of the nozzle communicating part is larger, along a direction parallel to a nozzle aperture face of the substrate, than a cross-section area of the nozzle aperture, and the cross-section area of the nozzle aperture in such direction remains constant over the entire length of the nozzle aperture.

7 Claims, 5 Drawing Sheets

LIQUID DISCHARGE HEAD AND PRODUCING METHOD THEREFOR

BACKGROUND OF THE INVENTION

1. Field of the Invention

The present invention relates to a liquid discharge head, having plural nozzle apertures, plural pressure generating chambers respectively communicating with the nozzle apertures, and a reservoir communicating with the plural pressure generating chambers, wherein a liquid droplet is discharged from each of the plural nozzle apertures by a discharge energy generated in each of the pressure generating chambers.

2. Related Background Art

A liquid discharge head, which applies a pressure to liquid thereby generating a flying liquid droplet, is widely utilized as a relatively inexpensive output device of a high performance. It is particularly utilized as photograph output means in combination with the recent pervasiveness of digital cameras, and the requirement for image quality is becoming stricter year after year. For this purpose, a finer discharged liquid droplet and a denser structure of liquid flow paths are essential requirements, and a producing method for the liquid discharge head has been proposed, utilizing a micromachining technology, which precisely prepares fine patterns on a silicon substrate, relatively simply by an anisotropic etching and the like.

For example Japanese Patent Application Laid-Open No. H07-156399 discloses, as shown in FIG. 5, an ink jet head prepared by integrally forming flow paths such as pressure generating chambers 503 and a reservoir, and vibrating plates 504 by applying an anisotropic etching on a silicon substrate, and adjoining a nozzle plate 501 having nozzle apertures 502. Such ink jet head, utilizing dependence of etching rate on the plane orientation of silicon single crystal, can prepare flow paths in precise and simple manner, and, involving the adjoining operation only in the nozzle plate 501, enables a simple manufacturing process with little intrusion of adhesive material into the flow paths and with a high reliability.

Also Japanese Patent Application Laid-Open No. H05-229128 discloses a producing method for an ink jet head which is prepared, as shown in FIG. 6, by applying an anisotropic etching to a silicon substrate to obtain a flow path substrate 600 integrally bearing pressure generating chambers 602 and nozzle apertures 601, to which a vibrating plate 605 having piezoelectric elements 606 is adjoined.

However, the invention disclosed in Japanese Patent Application Laid-Open No. H07-156399 involves following drawbacks:

(1) As the dependence of etching rate on the plane orientation of silicon single crystal is utilized, the usable substrate is limited and inevitably involves an increased cost;

(2) As the depth of the pressure generating chamber is determined by the thickness of the substrate, the depth of the pressure generating chamber and the thickness of the substrate cannot be determined independently. In case of arranging the pressure generating chambers at a high density, an increased depth of the pressure generating chamber renders a partition wall, between the adjacent pressure generating chambers, easily flexible, thus resulting in problems such as a pressure loss and a crosstalk. On the other hand, a large-area substrate is advantageous in cost in mass production, but a thin substrate involves a problem in handling, thus resulting in a trade-off relationship with the depth of the pressure generating chamber mentioned above;

(3) As the ink jet head is prepared by adjoining the flow path substrate bearing flow paths and the nozzle plate, the alignment between the flow path substrate and the nozzle plate becomes more difficult as the density of the structures increases. Thus, the reliability becomes lower particularly in a color-recording multi nozzle head requiring a large number of nozzles. Also in case the material of the nozzle plate and the silicon constituting the flow path substrate have different thermal expansion coefficients, the nozzle plate may become easily peelable by a temperature change involved in the manufacturing process or in the environment of use, thus deteriorating the reliability.

On the other hand, in the method disclosed in Japanese Patent Application Laid-Open No. H05-229128, since the flow paths including the pressure generation chambers and the nozzle apertures are formed in a same substrate, the aforementioned drawback relating to the adjoining of the nozzle plate and the flow path substrate no longer exists. However, as the flow paths are formed by anisotropic etching, the limitations on the usable substrate and on the producible shape remain the same. Also the thickness of the substrate is equal to a sum of the depth of the pressure generating chamber and the length of the nozzle aperture, so that the pressure generating chamber has to be made deeper or the nozzle aperture has to be made longer in order to use a thick substrate that is convenient for handling. However, a deeper pressure generating chamber leads to the aforementioned drawbacks of pressure loss or crosstalk, and a longer nozzle leads to an increased flow path resistance.

SUMMARY OF THE INVENTION

The present invention has been made in consideration of such situation, and an object thereof is to provide a liquid discharge head that is easy to manufacture and that has a highly precise flow path structure enabling a high density arrangement, and a producing method therefor. The liquid discharge head of the present invention is provided, on a same substrate, with plural pressure generating chambers, plural nozzle apertures communicating with the plural pressure generating chambers respectively through nozzle communicating parts, and a reservoir with which the plural pressure generating chambers commonly communicate, wherein a cross-section area of the nozzle communicating part is larger, along a direction parallel to a nozzle aperture face of the substrate in which the nozzle aperture is opened, than a cross-section area of the nozzle aperture in such direction, and the cross-section area of the nozzle aperture in such direction remains constant over the entire length of the nozzle aperture. Also the producing method for the liquid discharge head includes a step of applying an etching on one of two principal planes of a substrate thereby forming a pressure generating chamber and a nozzle communicating part, and a step of applying an etching on the other of the two principal planes of the substrate thereby forming a nozzle aperture which has a cross-section area smaller than a cross-section area of the nozzle communicating part in a plane parallel to the other principal plane of the substrate, and of which the cross-section area in such direction remains constant over the entire length of the nozzle aperture.

BRIEF DESCRIPTION OF THE DRAWINGS

FIGS. 1A, 1B and 1C illustrate a liquid discharge head in an embodiment 1 of the present invention, wherein FIG. 1A is a schematic cross-sectional view, FIG. 1B is a schematic partial plan view showing a state in which a vibrating plate in FIG. 1A is removed, and FIG. 1C is a schematic cross-sectional view along a line 1C-1C in FIG. 1B;

DETAILED DESCRIPTION OF THE PREFERRED EMBODIMENTS

The present invention provides following effects.

Since the nozzle apertures, the pressure generating chambers and the nozzle communicating parts, connecting the nozzle apertures and the pressure generating chambers, are formed on a same substrate, it is not necessary to connect separate members by adjoining or by adhesion. It is therefore possible to prevent a loss in the precision of the positions of the nozzle apertures, resulting from an alignment error at the adhering operation or from a difference in the thermal expansion coefficients. Also a cross-section area of the nozzle communicating part, along a direction parallel to a nozzle aperture face of the substrate in which the nozzle aperture is opened, is made larger than a cross-section area of the nozzle aperture in such direction. It is therefore rendered possible to employ a thick substrate that is advantageous for handling without extremely reducing the flow path resistance, while realizing a shallow pressure generating chamber necessary for a high density structure and a small nozzle aperture necessary for discharging a small liquid droplet.

Also the cross-section area of the nozzle aperture, along the direction parallel to the nozzle aperture face of the substrate in which the nozzle aperture is opened, is made constant over the entire length of the nozzle aperture, so that a velocity vector of the liquid passing through the nozzle aperture is so aligned as to be substantially parallel to the internal surface of the nozzle aperture, thereby improving stability of linear movement of the liquid droplet. Also, as the cross-section area of the nozzle communicating part is larger than that of the nozzle aperture, the tolerance for the positional aberration between the nozzle aperture and the nozzle communicating part becomes larger.

Also the substrate is etched plural times utilizing plural etching mask layers. More specifically, after an etching with an etching mask layer of a smaller aperture, such etching mask layer is selectively eliminated and a next etching is executed, thereby forming a recess having a deep step difference. In this method, the etching can be executed precisely and relatively easily.

In the following, embodiments of the present invention will be explained with reference to the accompanying drawings. In the present specification, terms "parallel", "same", "constant" and the like indicate meanings including an error in designing.

Also the present invention is applicable not only to an ink jet head utilizing a piezoelectric element, but also to that of bubble jet method in which a heat generating element is provided in the pressure generating chamber to generate a bubble thereby providing a liquid discharge energy.

Embodiment 1

Figure 1A:
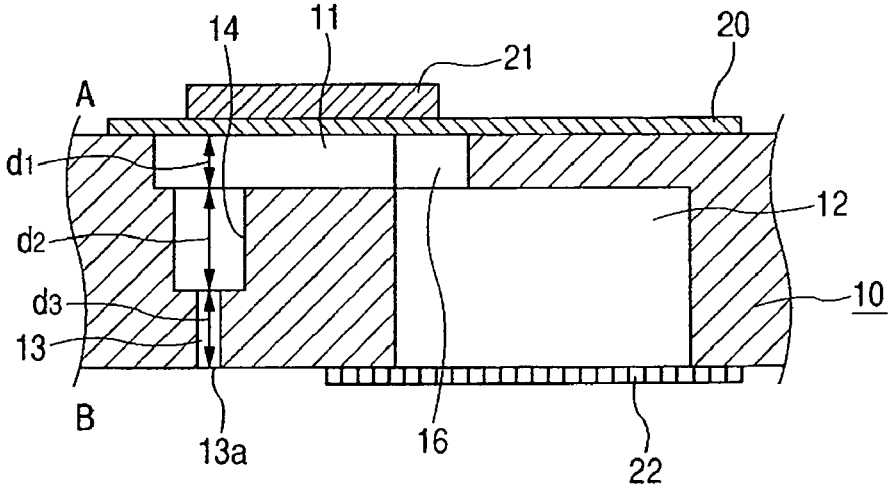
Figure 1B:
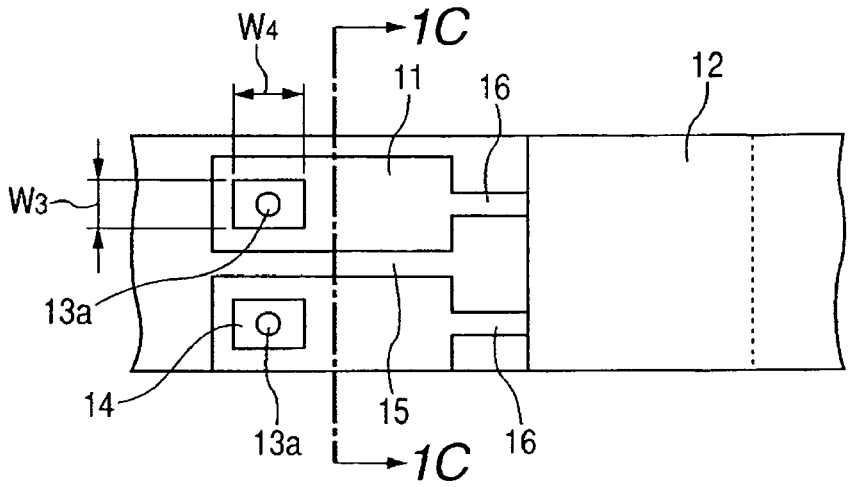
Figure 1C:
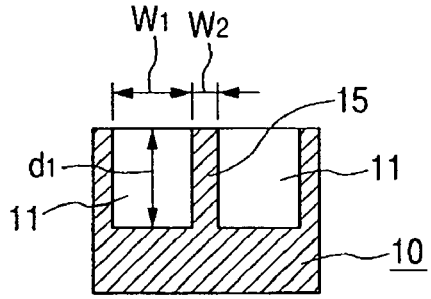

FIGS. 1A to 1C illustrate a liquid discharge head in an embodiment 1 of the present invention, wherein FIG. 1A is a schematic cross-sectional view, FIG. 1B is a schematic partial plan view showing a state in which a vibrating plate in FIG. 1A is removed, and FIG. 1C is a schematic cross-sectional view along a line 1C-1C in FIG. 1B.

As shown in FIGS. 1A to 1C, a pressure generating chamber 11, a nozzle communicating part 14, a nozzle aperture 13 and a reservoir 12 are formed in a substrate 10. A vibrating plate 20 and a piezoelectric element 21 are provided, among two opposed principal planes of the substrate 10, on a principal plane bearing the pressure generating chamber 11, and a sealing member 22 is provided on the other principal plane to close the aperture of the reservoir 12.

In the present embodiment, the substrate 10 was formed by a silicon substrate, and the vibrating plate 20 was formed by glass of a thickness of about 4 μm, having a thermal expansion coefficient of about $3.2\times10^{-6}$. The vibrating plate 20 can be prevented from being peeled off, by employing a material having a thermal expansion coefficient approximately same as that of the substrate 10. Also the vibrating plate 20 preferably has a heat resistance higher than a temperature required for forming the piezoelectric actuator. The piezoelectric element 21 was formed by sputtering a PZT layer of a thickness of about 2.5 μm and photolithographically patterning it to correspond to each pressure generating chamber 11. A sealing member 22 for sealing the aperture of the reservoir 12, made of a same glass material used for the vibrating plate 20 but having a thickness of 100 μm, was anodic bonded. The sealing member can be prevented from being peeled off, by employing a material for the sealing member having a thermal expansion coefficient approximately same as that of the substrate. Also at a side of the pressure generating chamber 11 communicating with the reservoir 12, a constricted part 16 with a narrower width is provided to regulate the flow path resistance. Also the adjacent pressure generating chambers 11 are separated by a partition wall 15.

As shown in FIG. 1C, a sum of a width w1 of the pressure generating chamber 11 and a width w2 of the partition wall 15 is determined by a desired density of arrangement. For example, w1+w2 becomes 127 μm for an arrangement density of 200 DPI. For the arrangement density of 200 DPI, there were selected a width w1 of 77 μm for the pressure generating chamber, and a width w2 of 50 μm for the partition wall. The nozzle communicating part 14, shown in FIG. 1B, was formed with w3 of 50 μm and w4 of 200 μm, in consideration of the flow path resistance, thus securing a cross-section area of 50 times or more of the nozzle aperture 13. The substrate 10 was formed by a silicon substrate of a thickness of 300 μm for the ease of handling, in which the pressure generating chamber was formed with a depth d1 of 100 μm, the nozzle communicating part with a depth d2 of 140 μm and the nozzle aperture with a depth d3 of 60 μm. The nozzle aperture 13*a*, on a surface opposite to the piezoelectric element 21, was formed with a diameter of 15 μm.

Thus, in spite that the fine nozzle apertures 13*a* are arranged at a density as high as 200 DPI, the pressure generating chamber 11 and the nozzle aperture 13*a* have a high positional precision with an extremely high reliability, by forming the nozzle apertures and the liquid flow paths such as the pressure generating chambers 11 integrally in a same substrate.

Also in spite of use of a substrate as thick as 300 μm, the pressure generating chamber 11 is limited to a depth of 100 μm thereby ensuring a sufficient rigidity in the partition wall 15, whereby a crosstalk was not observed in the driven state. The nozzle aperture 13*a* was formed with a diameter as small as 15 μm. However, the pressure generating chamber 11 and the nozzle aperture 13 could be communicated with a sufficiently small flow path resistance, by utilizing the nozzle communicating part 14 of a large cross-section area, for example 50 times or more of the cross-section area of the nozzle aperture 13, along a direction substantially parallel to the nozzle aperture surface (plane B) of the substrate 10, on which the nozzle aperture 13 is opened.

Also the cross-section area of the nozzle aperture 13 in a direction substantially parallel to the nozzle aperture surface of the substrate 10, on which the nozzle aperture 13 is opened is constant over the entire length of the nozzle aperture, so that the velocity vector of the fluid passing through the nozzle aperture 13 is aligned substantially parallel to the internal wall of the nozzle aperture 13, thereby improving stability of linear movement of the liquid droplet. The nozzle aperture 13 preferably has a length (dimension in a direction perpendicular to the nozzle aperture) of 20 μm or larger.

Also at the manufacturing process, a silicon substrate with a sufficient thickness of 300 μm enabled easy handling, thus reducing the substrate breakage at the manufacture and improving the production yield.

COMPARATIVE EXAMPLE 1

For the purpose of comparison, a head was prepared with a silicon substrate of a thickness same as in Embodiment 1, by forming the pressure generating chamber with a depth of 240 μm without changing the nozzle aperture and without forming the nozzle communicating part. In such head, a meniscus vibration was observed in a nozzle aperture corresponding to an adjacent non-driven portion, thus causing a crosstalk. Also when the nozzle aperture was formed with a depth d3 of 200 μm without changing the pressure generating chamber, the nozzle aperture corresponding to a driven portion showed a meniscus vibration but did not cause an ink discharge.

In the following, the steps of manufacturing the liquid discharge head of Embodiment 1 will be explained with reference to the accompanying drawings.

FIGS. 2A to 2G illustrate steps of the manufacturing method of the liquid discharge head.

Figure 2A:
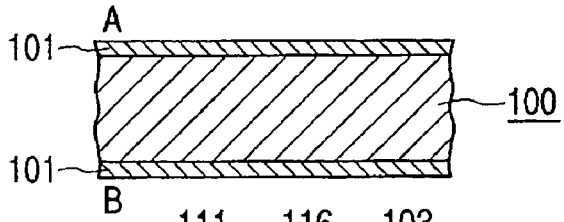
FIGS. 2A, 2B, 2C, 2D, 2E, 2F and 2G are schematic views showing steps of a producing method for the liquid discharge head of the embodiment 1 of the present invention.
Figure 2B:
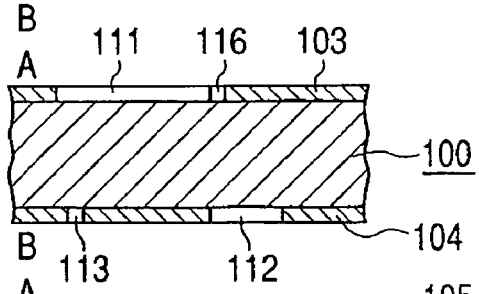

(1) At first, as shown in FIG. 2A, a silicon substrate 100 of a thickness of 300 μm was subjected to a thermal oxidation to form a thermal oxide film 101 thickness of 1 μm on each of the two principal planes A and B of the silicon substrate.

(2) After the step (1), the thermal oxide film 101 on the surface A was partly removed with a mixed solution of hydrofluoric acid and ammonium fluoride, to form a first etching mask layer 103 with an aperture corresponding to the pressure generating chamber 111 and the constricted part 116. Also the thermal oxide film 101 on the surface B was partly removed to form a first etching mask layer 104 having an aperture corresponding to the nozzle aperture 113 and an aperture corresponding to the reservoir 112.

Figure 2C:
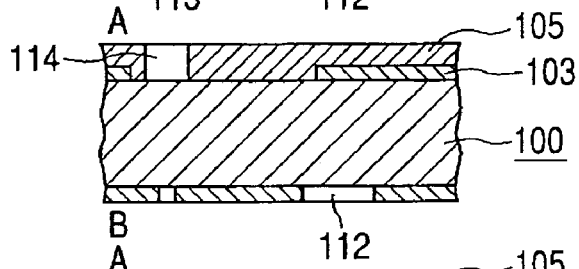

(3) After the step (2), on the first etching mask layer 103, a second etching mask layer 105 having an aperture corresponding to the nozzle communicating part 14 was formed as shown in FIG. 2C. In the present embodiment, the second etching mask layer 105 was formed by coating a positive photoresist, principally constituted of a novolac resin, with a thickness of about 4.5 μm, followed by ordinary exposure and development steps and by a heat treatment at 120° C. for 20 minutes thereby forming an aperture corresponding to the nozzle communicating part 114.

Figure 2D:
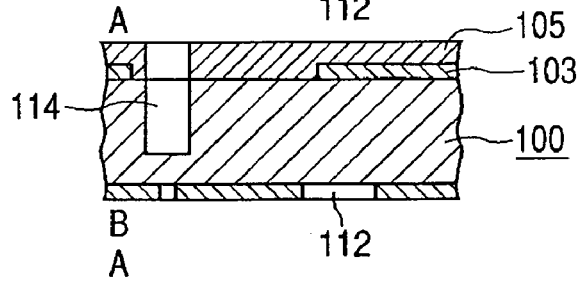

(4) After the step (3), the silicon substrate was subjected to a first etching utilizing the second etching mask layer 105 as shown in FIG. 2D to form a recess corresponding to the nozzle communicating part 114.

This step is preferably executed by a dry etching with an ICP (inductively coupled plasma) etching apparatus having a high etching rate and suitable for forming a large step difference. In the present embodiment, the etching was conducted under conditions of an ICP power of 1800 W, a substrate bias of 40 W and a substrate temperature 10° C. to form a recess approximately corresponding to the nozzle communicating part 114 of a depth of 150 μm. In this operation, the photoresist constituting the second etching mask layer 105 was etched by about 2 μm, and the selective ratio between the second etching mask layer 105 and the silicon substrate was about 75 under the aforementioned conditions.

Figure 2E:
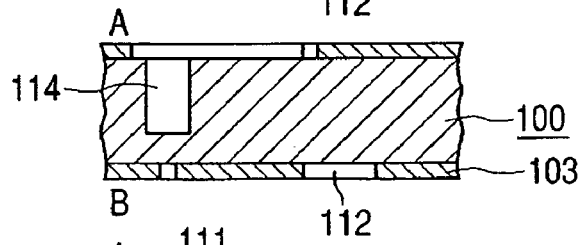

(5) After the step (4), the photoresist constituting the second etching mask layer 105 alone was eliminated as shown in FIG. 2E, by an oxygen plasma ashing. In the ICP apparatus employed for the first etching, oxygen gas was introduced after the first etching to execute an ashing for 10 minutes under conditions of an ICP power of 200 WS, a bias of 20 W and a substrate temperature of 20° C., thereby eliminating the photoresist only, without substantially affecting the thermal oxide film constituting the first etching mask layer 103.

Figure 2F:
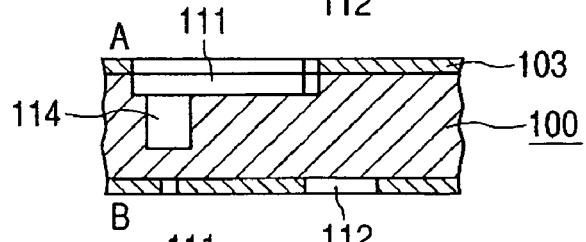
Figure 2G:
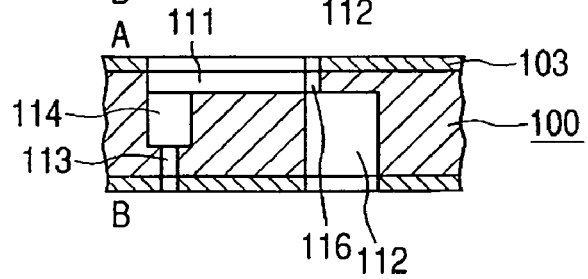

(6) After the step (5), the substrate was subjected, as shown in FIG. 2F, to a dry etching with an ICP (inductively coupled plasma) etching apparatus, utilizing the first etching mask layer 103. There were employed etching conditions same as those used for forming the recess corresponding to the nozzle communicating part 114, thus forming a recess corresponding to the pressure generating chamber 111 with an approximate depth of 100 μm. In this operation, the earlier formed recess corresponding to the nozzle communicating part 114 was also etched to a depth of about 240 μm from the surface of the substrate 100. An etched amount of the thermal oxide film 101 in such etching was about 0.4 μm, with a selective ratio of about 250 between the thermal oxide film 101 and the substrate 100.

(7) After the step (6), an ICP etching was conducted from a surface opposite to the surface on which the above-described dry etchings were conducted to make communication between the nozzle aperture 113 and the nozzle communicating part 114 and between the reservoir 112 and the pressure generating chamber 111, thereby completing the substrate 100. The thermal oxide films 101, remaining on both principal planes of the substrate 100, were removed with a mixed solution of hydrofluoric acid and ammonium fluoride, without substantially affecting the substrate 100.

Thus, by employing different etching mask layers of a thermal oxidation film and a photoresist for etching the substrate 100, and, after the first etching, eliminating the photoresist and executing the second etching by the first etching mask layer 103 formed by the thermal oxide film 101, it is made possible to form a three-dimensional structure with a step difference of 100 μm or larger, such as the pressure generating chamber 111 and the nozzle communicating part 114, by relatively simple steps of etchings from one side, without relying on a special method or apparatus such as a deep step difference patterning or a special etching. The first etching mask layer 103 may be formed by a silicon dioxide.

Embodiment 2

In the following, the steps of manufacturing the liquid discharge head of Embodiment 2 will be explained with reference to FIGS. 3A to 3G.

Figure 3A:
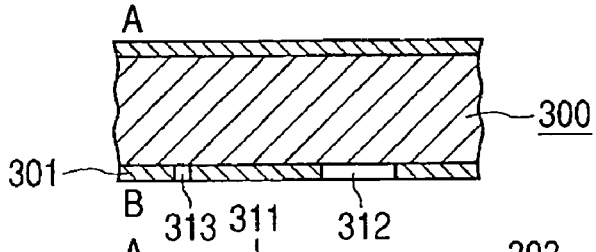
FIGS. 3A, 3B, 3C, 3D, 3E, 3F and 3G are schematic views showing steps of a producing method for a liquid discharge head of an embodiment 2 of the present invention.
Figure 3B:
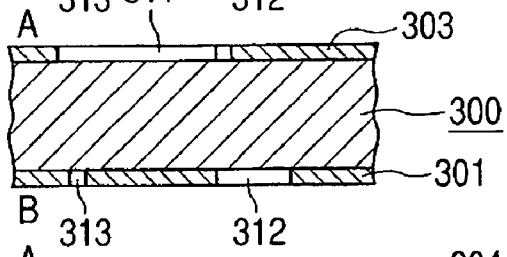

(1) A substrate 300 of a thickness of 300 μm, as in Embodiment 1, was thermally oxidized to form a thermal oxide film of a thickness of 1 μm, and, on a principal plane (surface B) opposed to a principal plane (surface A) on which the pressure generating chamber 311 is to be formed, an etching mask layer 301 was formed with an aperture corresponding to the nozzle aperture 313 and an aperture corresponding to the reservoir 312. The apertures were formed in the thermal oxide film with a mixed solution of hydrofluoric acid and ammonium fluoride as in Embodiment 1, and, in this operation, the thermal oxide film on the surface A, on which the pressure generating chamber 311 is to be formed, is simultaneously removed as shown in FIG. 3A.

(2) After the step (1), a positive photoresist constituted principally of a novolak resin was patterned on the principal plane (surface A) on which the pressure generating chamber 311 is to be formed, thereby obtaining a pattern having an aperture corresponding to the pressure generating chamber 311. In the present embodiment, the photoresist pattern was heatedly treated at 200° C. for 10 minutes to obtain a first etching mask layer 303 of a thickness of about 2.5 μm.

Figure 3C:
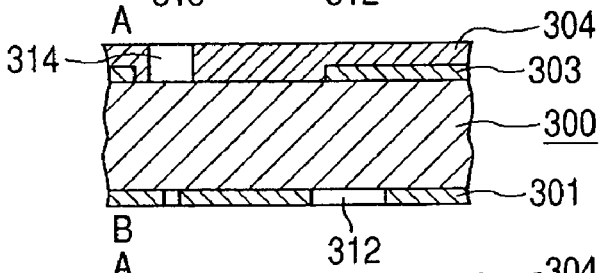

(3) After the step (2), a second etching mask layer 304, having an aperture corresponding to the nozzle communicating part 314, was prepared in the same manner as in Embodiment 1 (FIG. 3C). The first etching mask layer 303, having been heat treated at 200° C., did not experience a deformation but retained the desired shape in the steps of forming the second etching mask layer 304 including coating, exposure and development of a photoresist.

Figure 3D:
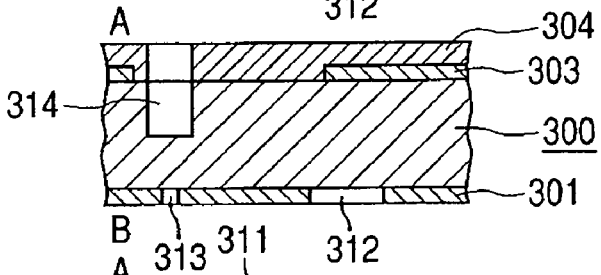
Figure 3E:
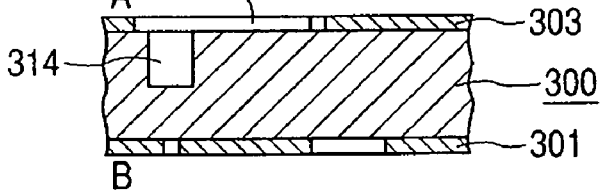

(4) After the step (3), a first ICP dry etching was executed as in Embodiment 1 to form a recess corresponding to the nozzle communicating part 314 (FIG. 3D). The conditions of forming the second etching mask layer 304 and of the first etching were same as those in Embodiment 1.

(5) After the step (4), the second etching mask layer 304 was removed. Since the oxygen plasma ashing, employed for removing the second etching mask layer in Embodiment 1, affects the first etching mask layer, the present embodiment employed an ultrasonic rinsing with an organic solvent for removing the second etching mask layer 304. There was employed a step of repeating an ultrasonic rinsing with acetone several times and then repeating an ultrasonic rinsing with isopropyl alcohol. In such organic solvent rinsing, no damage was observed on the first etching mask layer 303. This is presumably because the first etching mask layer 303 was heatedly treated at a temperature higher than that for the second etching mask layer 304, thereby showing a higher resistance to the organic solvents.

Figure 3F:
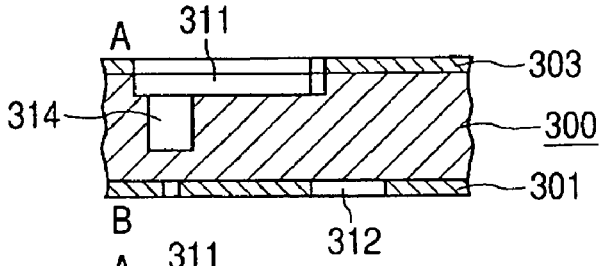
Figure 3G:
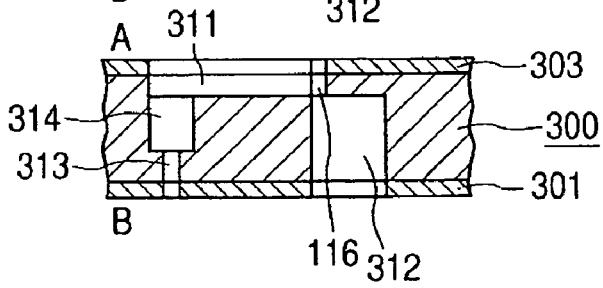

(6) After the step (5) of removing the second etching mask layer 304 by the organic solvent rinsing, a second ICP dry etching was conducted as in Embodiment 1 to form the pressure generating chamber 311 and the nozzle communicating part 314 as shown in FIG. 3F. The etching conditions were same as those in Embodiment 1. In this operation, the first etching mask layer 303 was etched by about 1.3 μm, corresponding to a selective ratio of about 75 between the first etching mask layer 303 and the substrate 300, which was same as in the second etching mask layer 304 of the lower heat treatment temperature.

(7) After the step (6), an ICP etching was conducted from an aperture side of the substrate 300 corresponding to the nozzle aperture 313 as in Embodiment 1 to make communication among the nozzle aperture 313, the nozzle communicating part 314, the reservoir 312, and the pressure generating chamber 311, thereby completing the substrate 300. The thermal oxide film remaining on the surface of the nozzle aperture 313 could be easily removed with a mixed solution of hydrofluoric acid and ammonium fluoride as in Embodiment 1. Also the first etching mask layer 303, formed on the side of the pressure generating chamber 311, was removed by an oxygen plasma ashing.

The producing method of the present embodiment can dispense, in comparison with Embodiment 1, with a step of patterning the thermal oxide film at the side of the pressure generating chamber 311. Also the etching mask layers formed by a thermal oxide film mask, a high-temperature treated resist mask and an ordinarily processed resist mask allow to form a more multi-stepped structure by etchings from one side only, thus expanding the field of application.

Embodiment 3

Figure 4A:
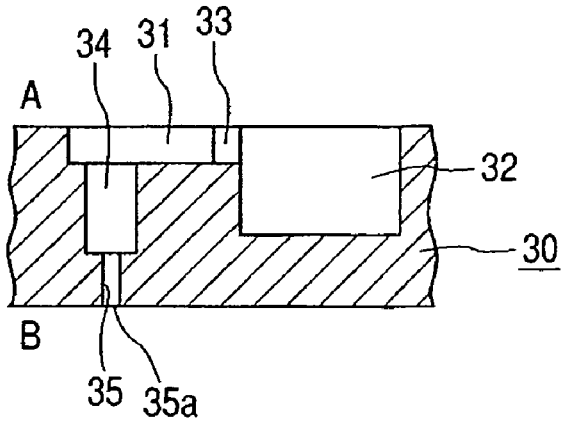
FIGS. 4A, 4B, 4C and 4D are schematic views showing steps of a producing method for a liquid discharge head of an embodiment 3 of the present invention.

A liquid discharge head of an embodiment 3 of the present invention has, as shown in FIG. 4A, a reservoir 32, a constricted part 33, a pressure generating chamber 31, and a recess corresponding to a nozzle communicating part 34 and a nozzle aperture 35, on a surface A side of a substrate 30.

Figure 4B:
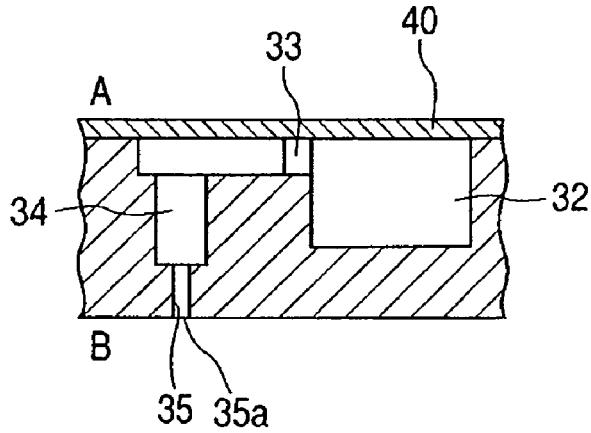
Figure 4C:
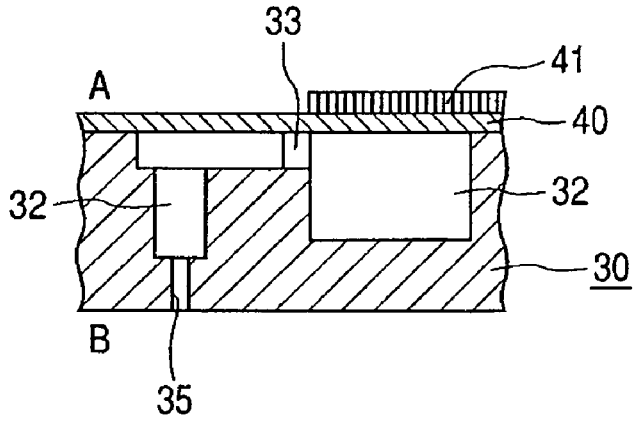
Figure 4D:
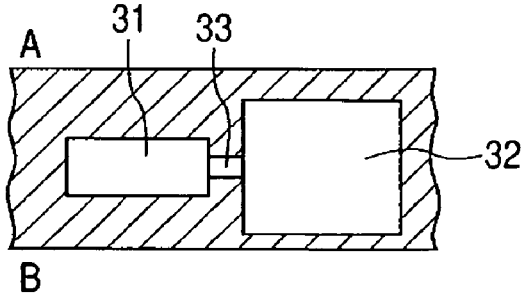
Figure 5:
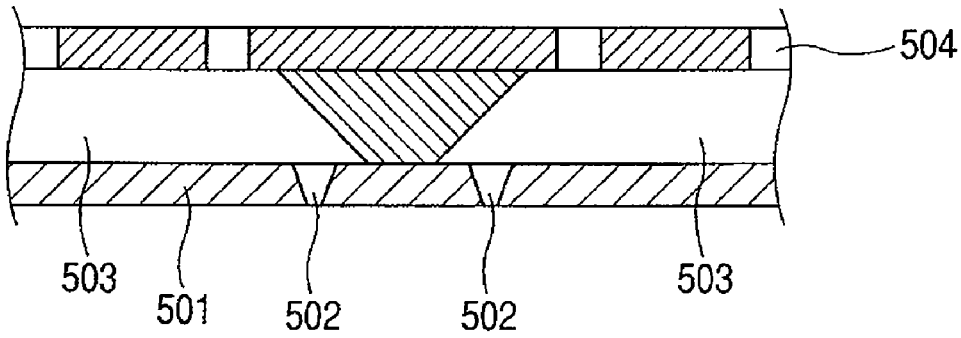
PRIOR ART FIG. 5
FIG. 5 is a schematic view showing an example of a prior liquid discharge head.
Figure 6:
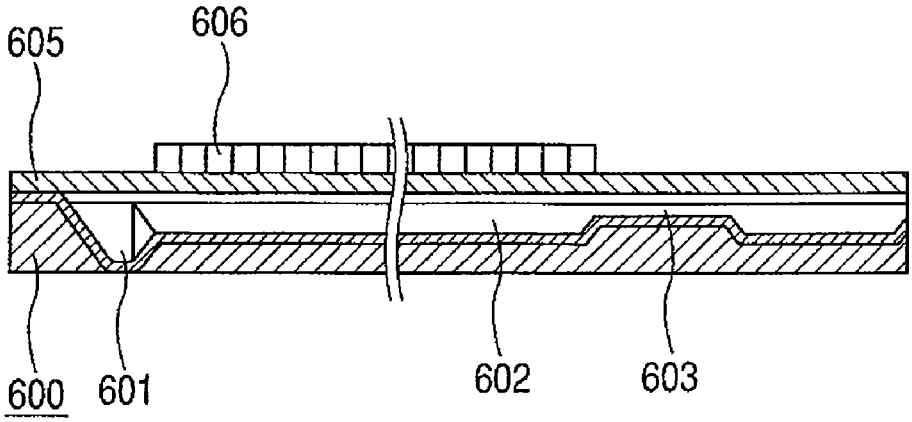
PRIOR ART FIG. 6
FIG. 6 is a schematic view showing another example of a prior liquid discharge head.

Then, as shown in FIGS. 4B and 4C, a vibrating plate 40 is provided on the surface A side, and a piezoelectric element 41 is provided thereon.

The liquid discharge head of the present embodiment can be prepared by a process similar to those of Embodiments 1 and 2, so that the producing process will not be explained in detail.

In the foregoing embodiments, the nozzle aperture has a circular shape, but such shape is not restrictive, and the nozzle aperture may also be formed as a rectangular, polygonal or star-like shape.

This application claims priority from Japanese Patent Application No. 2005-148895 filed May 23, 2005, which is hereby incorporated by reference herein.

What is claimed is:

1. A producing method for a liquid discharge head including plural pressure generating chambers, plural nozzle apertures communicating with the plural pressure generating chambers, respectively, through nozzle communicating paths, and a reservoir with which the plural pressure generating chambers commonly communicate, the method comprising:

a step of applying an etching on one of two principal planes of a substrate, thereby forming the pressure generating chambers and the nozzle communicating paths; and a step of applying an etching on another of the two principal planes of the substrate, thereby forming the nozzle apertures and the reservoir.

2. A producing method for a liquid discharge head according to claim 1, comprising:

a step of providing on the one of the two principal planes of the substrate, a mask layer for the pressure generating chambers having apertures corresponding to the pressure generating chambers and a mask layer for the nozzle communicating paths having apertures smaller than the apertures corresponding to the pressure generating chambers, and, on the other of the two principal planes of the substrate, a mask layer for the nozzle apertures having apertures smaller than the apertures corresponding to the nozzle communicating paths;

a step of forming the pressure generating chambers and the nozzle communicating paths, including a first etching on the substrate utilizing the mask layer for the nozzle communicating paths and then a second etching on the substrate utilizing the mask layer for the pressure generating chambers; and a step of executing a third etching on the substrate utilizing the mask layer for the nozzle apertures.

3. A producing method for a liquid discharge head according to claim 2, wherein the mask layer for the pressure generating chambers is formed by a thermal oxide film, and the mask layer for the nozzle communicating paths is formed by a photoresist.

4. A producing method for a liquid discharge head according to claim 2, wherein the mask layer for the pressure generating chambers is formed by silicon dioxide, the mask layer for the nozzle communicating paths is formed by a photoresist, and the substrate is formed by silicon.

5. A producing method for a liquid discharge head according to claim 3, wherein the substrate is etched by a plasma dry etching, and the mask layer for the nozzle communicating paths is removed by an oxygen plasma etching.

6. A producing method for a liquid discharge head according to claim 4, wherein the substrate is etched by a plasma dry etching, and the mask layer for the nozzle communicating paths is removed by an oxygen plasma etching.

7. A producing method for a liquid discharge head according to claim 2, wherein the mask layer for the nozzle communicating paths and the mask layer for the pressure generating chambers are both formed by photoresists, and the mask layer for the pressure generating chambers is heat treated at a temperature higher than that for the mask layer for the nozzle communicating paths.

* * * * *